US005509849A

United States Patent [19]

Spears, Jr.

[11] Patent Number: 5,509,849

[45] Date of Patent: Apr. 23, 1996

[54] BLAST NOZZLE FOR WATER INJECTION AND METHOD OF USING SAME FOR BLAST CLEANING SOLID SURFACES

[75] Inventor: William E. Spears, Jr., Lawrenceville, N.J.

[73] Assignee: Church & Dwight Co., Inc., Princeton, N.J.

[21] Appl. No.: 229,468

[22] Filed: Apr. 18, 1994

[51] Int. Cl.[6] ..... B24B 1/00; B24C 1/00

[52] U.S. Cl. ..... 451/40; 451/90; 451/102; 239/9; 239/434.5

[58] Field of Search ..... 451/40, 90, 102; 239/9, 10, 416.4, 416.5, 423, 424, DIG. 7, 427.3, 434.5

[56] References Cited

U.S. PATENT DOCUMENTS

| | | | |
|---|---|---|---|
| 3,514,041 | 5/1970 | Van Rooyen | 239/427.3 |
| 3,646,709 | 3/1972 | Nolan | 451/90 |
| 4,817,342 | 4/1989 | Martin et al. | 451/90 |
| 4,923,121 | 5/1990 | Boyer | 239/9 |
| 5,099,619 | 3/1992 | Rose | 451/102 |
| 5,165,602 | 11/1992 | Arnout et al. | 239/424 |
| 5,230,185 | 7/1993 | Kirschner et al. | 451/40 |
| 5,319,894 | 6/1994 | Shank, Jr. | 451/102 |
| 5,384,990 | 1/1995 | Spears, Jr. | 451/40 |

*Primary Examiner*—Bruce M. Kisliuk
*Assistant Examiner*—Thomas W. Lynch
*Attorney, Agent, or Firm*—Depaoli & Frenkel

[57] ABSTRACT

To reduce dust and improve the productivity of wet blasting, a blast nozzle and a method of using same are provided for directing a stream of abrasive particles entrained in compressed air to a targeted surface and for injecting a pressurized water stream into the stream of abrasive particles at a point downstream of the orifice of the blast nozzle and in the expansion portion of the nozzle. At the injection point, the velocity of the entrained abrasive particles is substantially equivalent to the velocity of the injected water stream.

16 Claims, 3 Drawing Sheets

BLAST NOZZLE FOR WATER INJECTION AND METHOD OF USING SAME FOR BLAST CLEANING SOLID SURFACES

BACKGROUND OF THE INVENTION

1. Field of the Invention

The present invention relates generally to blast nozzles for removing adherent material such as paint, scale, dirt, grease and the like from solid surfaces by directing a stream of abrasive particles propelled by a combination of liquid and air against the substrate surface. In particular, the present invention is directed to a novel and improved blast nozzle in which high pressure water is injected coaxially into a stream of abrasive particles entrained in air internally in the blast nozzle to improve dust control without reducing blast cleaning productivity.

2. Description of the Prior Art

In order to clean a solid surface so that such surface can again be coated such as, for example, to preserve metal against deterioration, or simply to degrease a solid surface such as surfaces contacting food or building structures which contain food serving or food processing operations, it has become common practice to use an abrasive blasting technique. In such process, abrasive particles are propelled by a high pressure fluid against the solid surface in order to dislodge previously applied coatings, scale, dirt, grease or other contaminants. Various abrasive blasting techniques have been utilized to remove the coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 1,000 psi and above, and a process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used. Water for dust control has been mixed with the air either internally in the blast nozzle or at the targeted surface to be cleaned and such latter process, although primarily a dry blasting technique, is considered wet blasting inasmuch as media recovery and clean up is substantially different from that utilized in a purely dry blasting operation.

A typical dry blasting apparatus as well as a wet blasting apparatus which utilizes highly pressurized air to entrain, carry and direct the abrasive blast media to the solid surface to be treated and high or low pressure water for dust control comprises a dispensing portion in which the blast media typically contained in a storage tank is entrained in highly pressurized air, a flexible hose which carries the air/blast media mixture to the blast nozzle and which allows the operator to move the blast nozzle relative to the surface to be cleaned and the blast nozzle which accelerates the abrasive blast media and directs same into contact with the surface to be treated. Water is added either internally in the blast nozzle and mixed with the air stream passing therethrough or a low pressure stream of water is provided externally of the blast nozzle and directed at the abrasive stream or surface to be treated so as to control dust. The blast nozzle is typically hand-held by the operator and moved relative to the targeted surface so as to direct the abrasive blast media across the entire surface to be treated.

The blast media or abrasive particles most widely used for blasting surfaces to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to non-soluble blast media such as sand, in particular, for removing adherent coatings from relatively soft substrates such as softer metals as aluminum, composite surfaces, plastics, concrete and the like is sodium bicarbonate. While sodium bicarbonate is softer than sand, it is sufficiently hard to remove coatings from aluminum surfaces and as well remove other coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Sodium bicarbonate, typically used as particles having average diameters of from about 50 to 1,000 microns, is more friable than sand. As the sodium bicarbonate media contacts the surface to be treated, small particles of the media are formed yielding a substantial amount of dust which invades the targeted area and closely surrounding environment, hindering the operator's vision of the targeted surface. Accordingly, it has become necessary to control the dust which is formed upon blasting with the very friable sodium bicarbonate blast media.

As expressed above, it is possible to control dust by mixing a stream of water with the air stream which propels the blast media. This has been accomplished by two distinct methods. In one method, the blast nozzle is provided with a water port in which water is injected into the blast nozzle to mix with the air stream and entrained blast media particles. This method has been very effective in controlling the dust of the particles subsequent to contacting the targeted surface. Unfortunately, the velocity of the media particles is reduced by the water and consequently, the productivity with respect to cleaning the targeted surface is substantially decreased by this method. Thus, defining performance of a blast nozzle as the rate in which a volume of coating is removed per time, injecting the water with the air stream which propels the blast media has greatly reduced the production rate relative to dry blasting.

Similarly, in high pressure water blasting, abrasives are added when necessary to increase the aggressiveness of the water stream. The effectiveness of the combined water and abrasive media stream is often wanting as it is difficult to add the abrasive particles moving at relatively low velocity with the high velocity water into a uniform mixture moving at the higher velocity.

A blast nozzle apparatus used to propel abrasive particles entrained in a mixed air and water stream against a target surface for cleaning is disclosed in afore-mentioned U.S.

Pat. No. 4,817,342. In this patent, the abrasive which is entrained in a compressed air stream is mixed with high pressure, e.g. 1500 to 4000 psi, water prior to or at the inlet of a venturi-type blast nozzle. The venturi-type blast nozzle is one which contains a converging portion, a venturi orifice and a downstream diverging portion in which the velocity of the abrasive particles is imparted by the thermodynamic expansion of the gas (air). In the diverging section of such blast nozzles, gas velocities in excess of sonic velocity are attained. Unfortunately, improvements in the productivity of the wet blasting nozzle are not substantially improved by the addition of abrasive inasmuch as the high pressure water has a substantially higher velocity than the abrasive at the inlet of the blast nozzle and thus, uniform mixing of the abrasive with the water stream is not readily achieved.

An alternative method to control dust has been to direct a low pressure water stream externally from the blast nozzle at the targeted surface to control the dust which forms at the contact point. While this process has yielded improved productivity relative to the internally directed water stream, dust control is only slightly improved relative to dry blasting and substantially inferior to the process in which the water stream is directed at the abrasive stream internally in the blast nozzle.

An object of the present invention is to provide a blast nozzle useful in wet blasting wherein a particulate abrasive entrained in compressed air is mixed with a high pressure liquid stream in a manner which achieves increased cleaning or performance rates above comparable prior art devices.

Another object is to improve a process for wet blast cleaning by which a particulate abrasive is mixed with a high pressure water stream so as to achieve increased cleaning or performance rates.

In view of the advantages of utilizing sodium bicarbonate as a blast media as enumerated above, including water solubility to improve clean up, less harmful to the environment and useful to clean a wide variety of different surface types, still another object of the invention is to improve the processes and apparatus for using water soluble abrasive media such as sodium bicarbonate blast media in a manner to reduce the dust and, at the same time, maintain the productivity found in dry blasting.

SUMMARY OF THE INVENTION

In accordance with the present invention, a venturi-type blast nozzle is provided for directing a stream of abrasive particles in a pressurized fluid stream comprising a mixture of high pressure air and water in a manner so as to improve the mixing of the two pressurized fluids and abrasive at high velocity and consequently control dust formation and maintain the high blast cleaning productivity of the blast nozzle comparable to dry blasting. The blast nozzle of this invention includes means to inject high pressure water into and coaxially with the stream of abrasive particles entrained in pressurized air at a point in the blast nozzle which is downstream of the throat of the venturi-type blast nozzle. At a point downstream of the blast nozzle orifice, the air stream is approaching or exceeding sonic velocity similar to the velocity of the high pressure water stream. Uniform mixing of the two fluid streams is thereby more readily achieved as the velocity of the abrasive particles entrained in the air stream approaches the velocity of the high pressure water stream.

Alternative embodiments of the water injection means are provided according to the invention. The water injection means of both alternative embodiments comprises a water injection wing disposed within the bore of a water distribution housing. The water injection wing has an outlet orifice which has attached thereto a water exit tube which is placed within the blast nozzle coaxially with the direction of flow of the abrasive stream. The water exit tube has an outlet downstream of the blast nozzle orifice. Each water injection wing has a radially directed passage which communicates with the outlet orifice and with a water supply passage in the water distribution housing to which pressurized water is supplied. The alternative embodiments differ with respect to the orientation of the water injection wing in the bore of the housing and the means to distribute the pressurized water from the water distribution housing to the water injection wing.

The water injection wing of each embodiment according to the invention is secured within the bore of the water distribution housing which is juxtaposed onto the inlet of the blast nozzle. The water injection wing is placed in the path of the flow of air and abrasive downstream of the inlet end of the housing. The water injection wing has a cross-sectional area facing the flow path of the abrasive which is small relative to that of the bore of the housing. The shape of the water injection wing operably facilitates the flow of air and abrasive around the wing.

Each of the water injection wings has a shape defined by an integral central body portion and leading and lagging edges. The leading edge faces the inlet end of the housing bore. The lagging edge faces the outlet end of the housing bore. The radially directed passage of the water injection wing is disposed in the central body portion.

The leading edge is formed of opposed surfaces which angle inwardly respectfully from the central body portion toward the longitudinal axis of the bore. The width of the leading edge is small relative to the width of the central body portion. The lagging edge is formed of opposed surfaces which angle inwardly respectively from the central body portion toward the longitudinal axis of the housing bore and terminate at the lagging edge disposed toward the outlet end of the housing. The water injection wing includes a slot which extends from the central body portion generally parallel to the longitudinal axis of the bore of the housing to the outlet orifice placed at the lagging edge. Connected to the outlet orifice of the lagging edge is the hollow exit tube which directs the high pressure water stream and injects same into and coaxially with abrasive/air stream at a point downstream of the blast nozzle orifice.

The differences between the embodiments of the water injection means of this invention include differences in the means to distribute the high pressure water to the water injection wings. In the first embodiment, a water distribution member comprising a cap is secured to the top of the water injection wing and which rests above the water distribution housing. The cap has a water inlet passage which communicates with the radial passage in the central body portion of the wing and with a supply hose for the high pressure water. In the second embodiment, the water distribution member is a fluid directing collar which fits within the bore of the water distribution housing and surrounds the water injection wing. The collar includes an external water directing groove which contains two radially opposed inlets which communicate with the radially placed passage in the water injection wing. The water directing groove on the external surface of the fluid directing collar communicates with a passage in the housing which is connected to a supply hose for the high pressure water.

The two embodiments also differ with respect to the orientation of the water injection wing within the housing. In the first embodiment, the water injection wing is orientated vertically with respect to a longitudinal cross-section through the blast nozzle and water distribution housing assembly. In the second embodiment, the water injection wing is orientated horizontally relative to a longitudinal cross-section through the blast nozzle assembly.

DETAILED DESCRIPTION OF THE INVENTION

Figure 1:
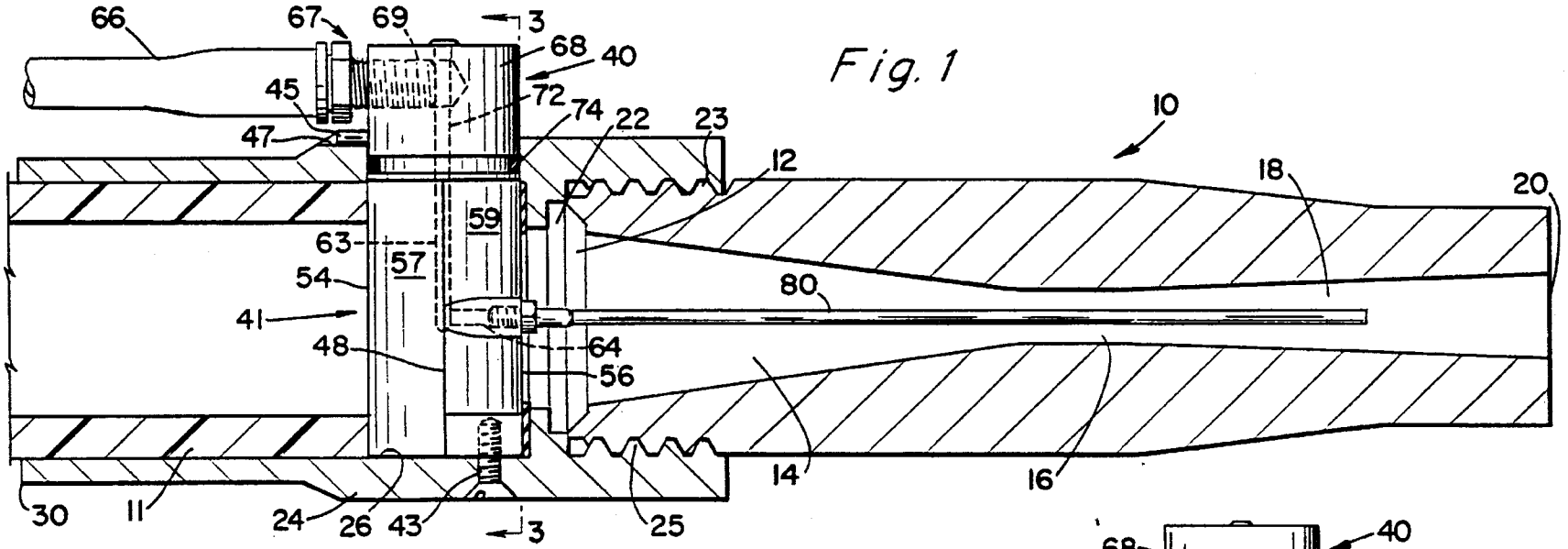
FIG. 1 is a longitudinal cross-section through the blast nozzle and water distribution and injection assembly of the present invention.

As shown in FIG. 1, blast nozzle 10 is of the venturi-type containing a longitudinal bore therethrough. The bore comprises an inlet 12, a converging portion 14, an orifice 16 and a diverging portion 18 which diverges to outlet 20. The bore of blast nozzle 10 defines a straight longitudinal axis from inlet 12 to outlet 20. Blast nozzle 10 is removably secured to the outlet end 22 of generally tubular water distribution housing 24 via threads 23 and 25 on blast nozzle 10 and housing 24, respectively. Housing 24 has a bore 26 formed therein defining a longitudinal axis. Bore 26 includes an inlet end 30 for receiving air/abrasive supply hose 11.

Figure 3:
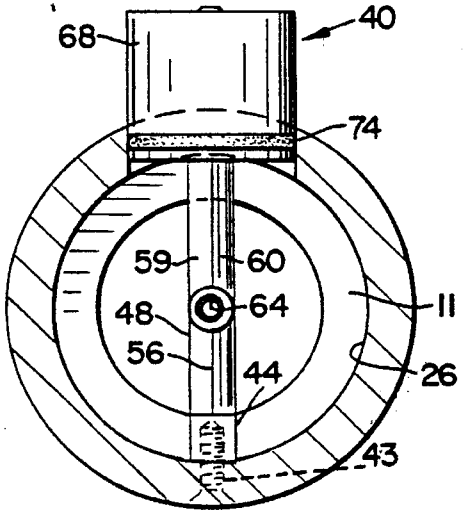
FIG. 3 is a transverse cross-section of the assembly of this invention taken through line 3—3 of FIG. 1.

The bore 26 of housing 24 is substantially straight, defining a longitudinal flow path for an entering stream comprising a mixture of particulate abrasive and air. Between the inlet end 30 and the outlet end 22 of housing 24, a water injection member 40 is secured in the bore 26 directly in the flow path of the entering mixture of abrasive and air. As best seen in FIG. 3 the cross-sectional area of water injection member 40 which faces the flow path of the abrasive and air mixture in bore 26 is small relative to that of the bore.

Figure 4:
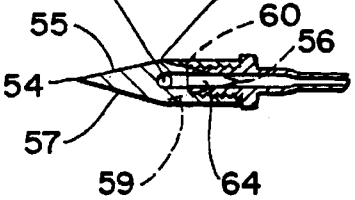
FIG. 4 is a transverse cross-section of the water injection means of this invention taken along lines 4—4 of FIG. 2.
Figures 2, 5, 6, 7, 8:
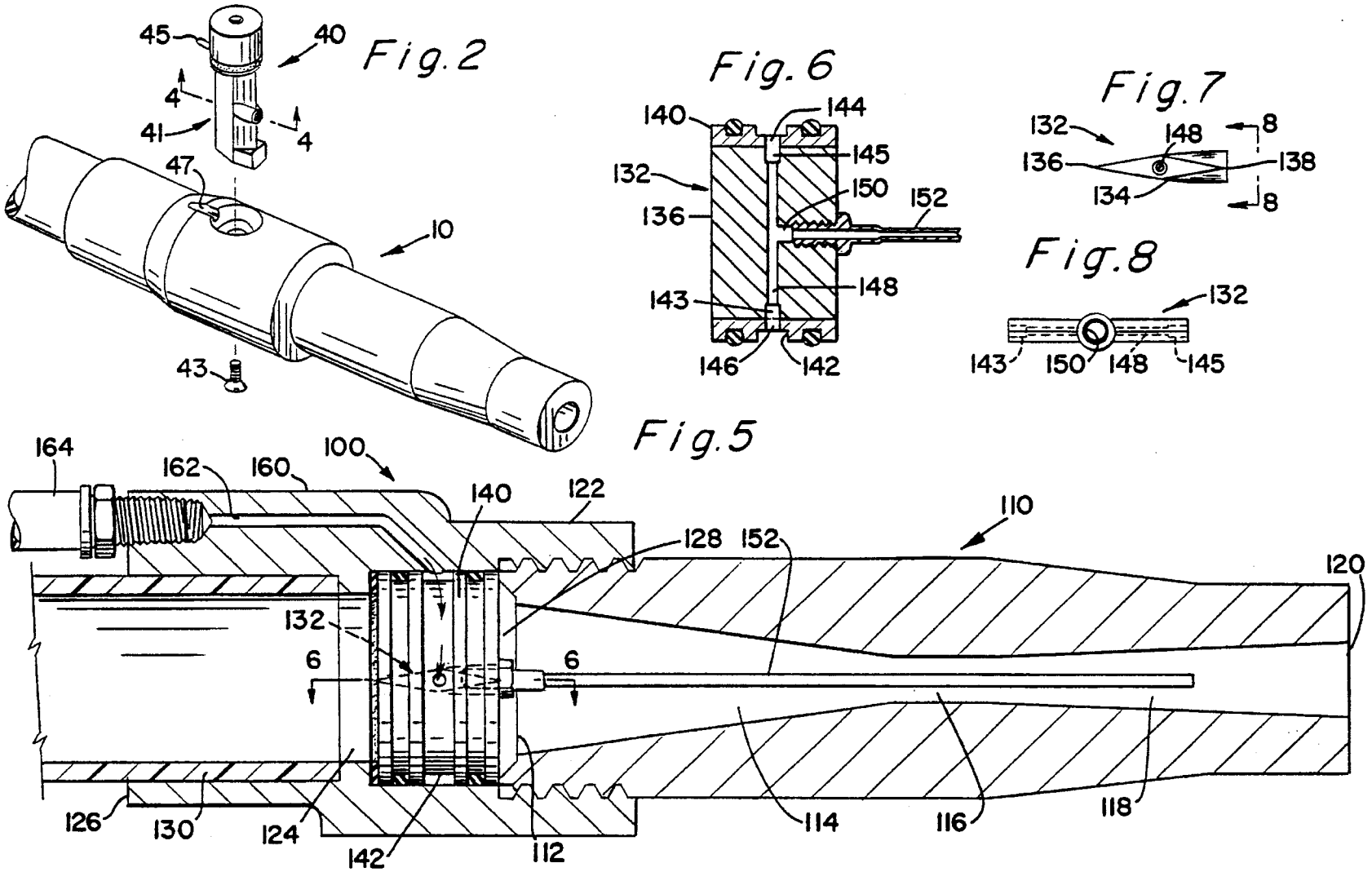
FIG. 2 is a perspective view of the blast nozzle and water injection assembly of the present invention with the water injection means shown separated from the blast nozzle.
FIG. 5 is a longitudinal cross section through an alternative blast nozzle and water distribution and injection assembly.
FIG. 6 is a cross section taken horizontally along line 6—6 of FIG. 5 through the fluid directing collar and the water injection wing.
FIG. 7 is a side elevation of the water injection wing as shown in FIG. 5.
FIG. 8 is an end view of the water injection wing taken along line 8—8 of FIG. 7.

Referring to FIGS. 1, 3 and 4 the water injection member 40 includes a wing 41 which contains a central body portion 48, leading edge 54 which faces inlet end 30, and lagging edge 56 which faces outlet end 22. The leading edge 54 is formed by lateral side surfaces 55, 57; and the lagging edge 56 is formed by lateral side surfaces 59, 60. The water injection wing 41 as illustrated in FIGS. 1 and 2, is secured to housing 24 by screw 43 threaded from the bottom of housing 24 into base 44 of wing 41 and by alignment pin 45 which rests in slot 47 at the top of housing 24.

The lateral side surfaces 55, 57 angle inwardly toward the longitudinal axis of bore 26 from the center of body 48 and terminate at leading edge 54. The width of leading edge 54 is smaller than the width of the central body portion 48 and creates a leading shape similar to the leading edge of an airplane wing. Such "streamlined" or winged shape in the path of a flow of pressurized air and abrasive causes the flow of air and abrasive to flow past the water injection wing 41 with minimal erosion of the leading edge 54 in particular and the entire water injection wing 41 in general.

The lagging or trailing edge 56 of the water injection wing 41 has its lateral side surfaces 59, 60 also angled inwardly toward the longitudinal axis of bore 26 from their integral connection with the center of body portion 48 as shown in FIG. 4. The side surfaces 59, 60 terminate in lagging edge 56 which, like leading edge 54, has a width smaller than the width of central body portion 48.

A threaded slot 64 is provided in wing 41 and extends from lagging edge 56 toward central body portion 48. Radial water inlet passage 63 in body portion 48 communicates with slot 64. As seen in FIGS. 1 and 4, slot 64 is aligned with the longitudinal axis of bore 26 and opens in an outlet which faces the outlet end 22 of the bore 26 and is juxtaposed to inlet 12 of blast nozzle 10.

Threaded into slot 64 is water exit tube 80 which is a hollow tube that directs the high pressure water passing through the water injection wing 41 directly into and coaxially with the stream of abrasive and compressed air at a point downstream of orifice 16 of blast nozzle 10. It is important to add the water to the mixed stream of abrasive and compressed air stream downstream of orifice 16 since it is at this point that the velocities of the high pressure water and the compressed air are similar providing the better mixing of the water, air and particulate abrasive. The water exit tube 80 must have a small enough diameter so as to fit within the orifice 16 of blast nozzle 10 and provide clearance to allow the abrasive to pass therethrough without disrupting the flow.

High pressure water is supplied to the water injection member 40 of the present invention by means of a water supply hose 66 which is connected to water distribution cap 68 which is cast, welded or otherwise attached to water injection wing 41. Water distribution cap 68 contains a threaded water supply passage 69 which receives the threaded coupling 67 from water supply hose 66. Placed within cap 68 is water directing passage 72 which communicates with water supply passage 69 and with water inlet passage 63 contained within water injection wing 41. An o-ring 74 prevents any leakage of water from the water distribution cap 68. In operation, high pressure water through hose 66 passes through water supply passage 69 into water directing passage 72 in water distribution cap 68 which directs the high pressure water into water inlet passage 63 in water injection wing 41. From passage 63, the high pressure water passes through slot 64 and then into water exit tube 80 where it is injected to the compressed air stream at a point downstream of orifice 16 of blast nozzle 10.

In operation of the blast nozzle and water distribution and injection means of this invention, a substantially constant flow rate of air and particulate abrasive is presented to the inlet end 30 of bore 26 of water distribution housing 24. The wing or air foil effect of leading edge 54 of water injection wing 41 causes the air and abrasive mixture to flow around the water injection wing 41 in a relatively streamline flow past the lagging edge 56 in bore 26. The air and abrasive mixture is accelerated through blast nozzle 10 as it converges and passes through orifice 16 and then expands in diverging portion 18 of blast nozzle 10. High pressure water through exit tube 80 is injected into the air and abrasive mixed stream coaxially therewith downstream of orifice 16 toward the outlet end 20 of blast nozzle 10. The velocity of the water as it is injected via exit tube 80 coaxially into the mixed stream of abrasive and air is on the order of 500 feet per second. At the point downstream of the venturi orifice 16 of blast nozzle 10 where the water injection takes place, the air is accelerated to a velocity of about 1100 ft/sec, imparting an approximate velocity of 500 ft/sec on the entrained abrasive thereby allowing a more uniform mixing of the abrasive and water. Consequently, the injection of the water stream does not adversely affect the velocity of the abrasive particles. The velocity of the water from exit tube 80 and velocity of the abrasive particles downstream of orifice 16 of blast nozzle 10 are similar, resulting in optimum mixing of the two streams. In previous water injection systems, the water was at a substantially higher velocity than the air stream and simply blew through the abrasive and air mixture without accelerating the abrasive particles, causing nonuniform mixture throughout the blast nozzle and resulting in a less than optimum abrasive velocity. Increased performance is also due to the fact that the air and abrasive stream and pressurized water are coaxially mixed in the nozzle without having angular turns of either of the water jet or the abrasive along the flow path through the water distribution housing or the blast nozzle.

An alternative water distribution means is shown in FIGS. 5–8. As shown in FIG. 5, the water distribution means 100 is secured to venturi-type blast nozzle 110 equivalent to blast nozzle 10 and which includes a longitudinal bore therethrough containing inlet 112, a converging portion 114, an orifice 116, and a diverging or expansion portion 118 which leads to outlet 120. The mixture of compressed air and abrasive is accelerated as the mixture passes through orifice 116 and expands in diverging portion 118.

Water distribution means 100 includes water distribution housing 122 which contains a longitudinal bore 124 therethrough. Bore 124 contains an inlet 126 and an outlet 128 which is juxtaposed with inlet 112 of blast nozzle 110. Bore 124 accommodates supply hose 130 which carries the mixture of compressed air and abrasive particles to blast nozzle 110. The water injection means of this embodiment includes a water injection wing 132 disposed within bore 124 of housing 122. As clearly shown in FIG. 7, the water injection wing 132 includes a central body portion 134 which narrows respectively to leading edge 136 and lagging edge 138 substantially equivalent to water injection wing 41. In this alternative embodiment, however, the water injection wing 132 is disposed horizontally in bore 124. Leading edge 136 faces the inlet 126 of bore 124 while lagging edge 138 faces the outlet 128 of bore 124.

The water injection wing is secured within a fluid directing collar 140 which is disposed within bore 124. As shown in FIGS. 5 and 6, water directing collar 140 contains an external groove 142 around the circumference of the collar and which channels water to two radially opposed collar inlet ports 144 and 146 communicating with the external surface of water directing groove 142. Contained within the central body portion 134 of water injection wing 132 is a passage 148 which extends the whole transverse length of water injection wing 132. At the respective ends of passage 148 are water inlet ports 143 and 145 which are juxtaposed with collar inlet ports 144 and 146, respectively. Communicating with passage 148 is a threaded passage 150 in central body portion 134 which extends along the longitudinal axis of bore 124 to the lagging edge 138 of water injection wing 132. Threaded within passage 150 is water exit tube 152 which is a hollow tube which injects the water passing through the water injection wing 132 into the blast nozzle at a point downstream from orifice 116 into the diverging or expansion portion 118 of blast nozzle 110.

Contained with water distribution housing 122 is an enlarged portion 160 which includes water inlet passage 162. High pressure water supply hose 164 can be threaded into portion 160 and communicate with water inlet passage 162. Passage 162 communicates with bore 124 and directs water from water supply hose 164 into water directing groove 142 on collar 140. High pressure water passing through groove 142 enters water inlet ports 144 and 146 and then into transverse passage 148 in water injection wing 132. Water then passes through lagging edge water injection passage 150 into water exit tube 152 whereupon the high pressure water is injected directly into the compressed air stream which contains entrained abrasive particles at a point downstream from orifice 116 of blast nozzle 110.

Figure 9:
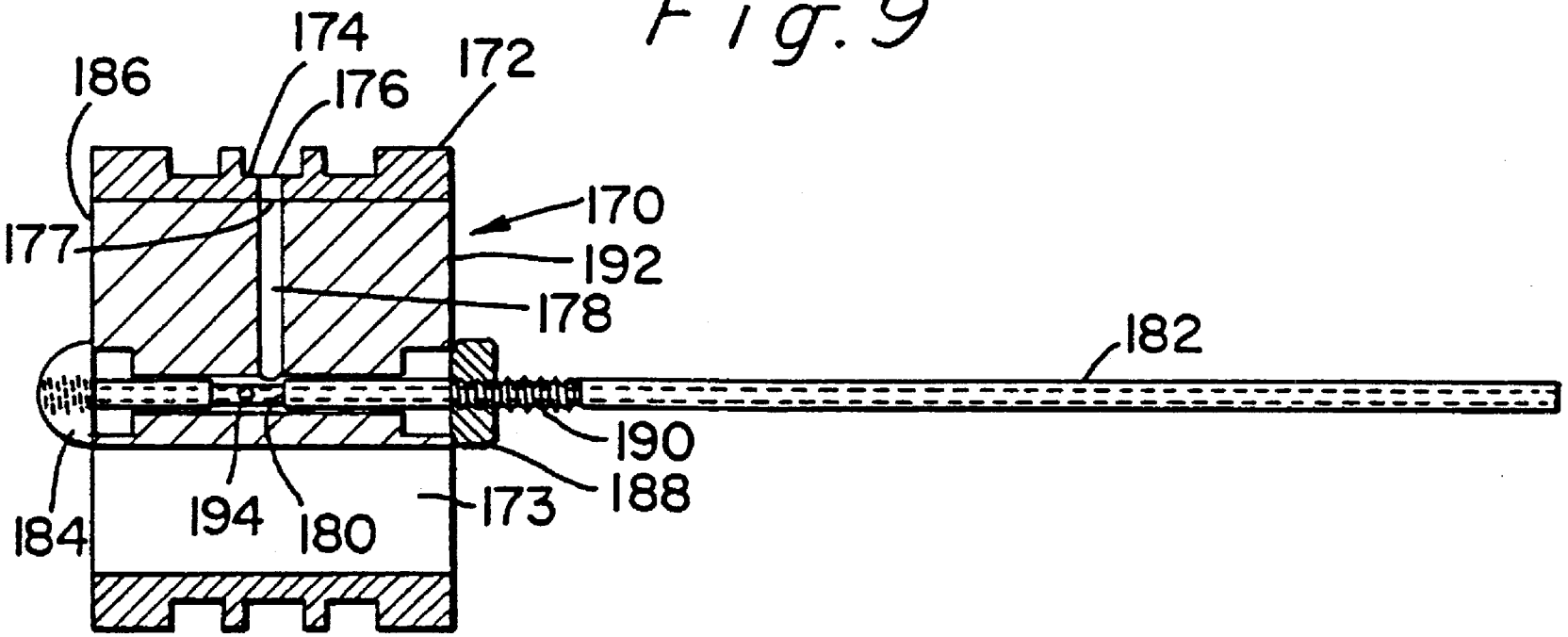
FIG. 9 is a cross section of an alternative collar and water injection wing assembly to that shown in FIG. 6 in which a half wing is used.

Shown in FIG. 9 is an alternative to the fluid distribution collar and water injection wing design shown in FIGS. 5 and 6. In the embodiment shown in FIG. 9, the water injection wing 170 is one half the transverse length of water injection wing 132 shown in FIG. 6. The water injection wing 170 is secured such as by welding within a fluid directing collar 172 as in the previous embodiment only that wing 170 is secured to only one edge of collar 172. The emply half 173 of collar 172 provides an unobstructed flow path for the abrasive and pressurized air. The water directing collar 172 contains an external groove 174 around the circumference thereof which channels the water from a supply to a single collar water port 176 which communicates with the external surface of water directing groove 174. Contained within the central body portion of half wing 170 is a water passage 178 which extends from inlet port 177 to longitudinal passage 180. Inlet port 177 communicates with water port 176 in fluid directing collar 172. The longitudinal passage 180 extends the full longitudinal length of water injection wing 170. Placed within longitudinal passage 180 is hollow water exit tube 182. Water exit tube 182 is held in place within passage 180 by a stop 184 which is threaded onto the upstream end of water exit tube 182 and secures the water exit tube against the leading edge 186 of injection wing 170 and by nut 188 which is threaded onto water exit tube 182 at threads 190 and is secured against lagging edge 192 of water injection wing 170. Placed within water exit tube 182 is an inlet port 194 which communicates with longitudinal passage 180 in the water injection wing 170. Equivalent to FIG. 5, water supplied to groove 174 passes through ports 176 and 177 into passages 178 and 180 and into exit tube 182 via port 194. The water exit tube 182 injects the water passing through water passage 178 of water injection wing 170 and inlet port 194 into the blast nozzle at a point downstream from the orifice of the blast nozzle and into the diverging or expansion portion of the nozzle.

The improved results with respect to cleaning productivity found with the first embodiment of the water injection means (as shown, e.g., in FIGS. 1–4) of this invention is also found in the second embodiment of the water injection means (as shown, e.g., in FIGS. 5–9) of this invention, inasmuch as the water is injected into the air stream which contains the entrained abrasive particles at a point downstream of the blast nozzle orifice. In fact, the only differences in the embodiments is the means by which the water is supplied to the exit tubes. In this respect, other modifications of this invention can be made without departing from the scope thereof by utilizing other methods of injecting the water into the compressed air and abrasive mixed stream so long as the water is injected into the air stream at a point where the air velocity is at least similar to the velocity of the water. It is important also that the water be injected into the compressed air stream coaxially therewith through the nozzle.

In operation of either embodiment of the water injection means used in the apparatus, the compressed air stream is typically at a pressure of 30 to 125 psi while the water pressures are at least about 1000 psi and typically from 3000 to 10,000 psi. The particulate abrasive can be any of those known including hard abrasives such as sand and aluminum oxide but can include softer abrasives as well such as plastic, walnut shells, rice hulls, etc. Preferably, the blast media is water soluble such as sodium sulfate, sodium sesquicarbonate and sodium bicarbonate. Most preferably, the abrasive particles comprises sodium bicarbonate. Sodium bicarbonate blast media is relatively soft so it does not harm relatively soft metals such as aluminum surfaces or composite surfaces such as plastic laminates and the like. At the same time, the sodium bicarbonate abrasive is hard enough to remove previous coatings, rust, grease and oil from such surfaces. As stated previously, sodium bicarbonate is very friable and will form a considerable amount of dust upon contacting the targeted surface. The blast nozzle assembly of the present invention not only greatly reduces the amount of dust which is formed by the bicarbonate, but also maintains high cleaning productivity on the order of dry blasting. Thus, the internally injected water controls dust formation and by injecting the water at a point downstream of the blast nozzle orifice, there is not found the drastic reduction in velocity of the abrasive particles as has been found previously with other water injection devices.

EXAMPLE

A blast nozzle containing a water injection means of the invention is provided as follows: A blast nozzle containing a 1¼ inch inlet, a ½ inch orifice and a ¾ inch outlet has a diverging section which is 6 inches in length. A water directing collar and a half water injection wing assembly as shown in FIGS. 5 and 9 is formed in which the collar is 1¼ inch long and has an O.D. of 1.7 inches and an inside diameter of 1.5 inches. The water directing channel around the collar is 0.24 inches across. The collar fits within a housing having an I.D. of 2.12 inches and an O.D. of 2.5 inches and a length of 5.25 inches including the threaded portion which secures the housing onto the blast nozzle.

The exit tube is a 304 stainless tube 5.25 inches in length and has an O.D. of 0.125 inches and an I.D. of 0.09 inches. The inlet port of the exit tube has a diameter of 0.04 inches.

An air pressure of 60 psi is used to entrain and direct a sodium bicarbonate blast media. Water at a pressure of 1,000 psi is directed to the exit tube. An aluminum sheet painted with an epoxy paint is blasted with the bicarbonate media. Little dust is formed and productivity of the nozzle is equivalent to that found using external water at 30 psi for dust control.

What is claimed is:

1. An apparatus for directing a particulate abrasive against a targeted surface for cleaning contaminants therefrom, comprising: a blast nozzle having a longitudinal bore therethrough for accelerating a stream of abrasive particles in compressed air, said bore comprising an inlet for receiving said stream, a converging section immediately downstream of said inlet, an orifice downstream of said converging section and a diverging section downstream of said orifice, said diverging section leading to an outlet, and a water injection means for injecting a stream of pressurized water directly into the stream of abrasive particles and compressed air at a point downstream of said orifice and in said diverging section, said injection means injecting said water coaxially with said stream of abrasive particles and compressed air.

2. The apparatus of claim 1 wherein said water injection means comprises a hollow tube extending from a water supply means coaxially through said bore and extending through said orifice, said hollow tube containing an outlet in said diverging section of said bore.

3. The apparatus of claim 2 wherein said water supply means includes a water distribution housing upstream and contiguous with said blast nozzle, said housing including a longitudinal bore therethrough from an inlet to an outlet for receiving said stream of abrasive particles and compressed air and directing said stream to said inlet of said blast nozzle, said outlet of said housing juxtaposed with said inlet of said blast nozzle, said hollow tube extending from a water distribution means placed in said housing adjacent to the outlet of said housing.

4. The apparatus of claim 3 wherein said water distribution means comprises a water injection wing disposed within said water distribution housing, said water injection wing including a water passage therethrough which communicates with a supply of pressurized water and said hollow tube, said water injection wing having a width which is narrower than said housing bore.

5. The apparatus of claim 4 wherein said water injection wing contains a leading edge facing said housing inlet, a lagging edge facing said housing outlet, and a central body portion, said leading edge and said lagging edge having a width which is smaller than the width of said central body portion so as to facilitate flow of said stream of abrasive particles and compressed air through said housing.

6. The apparatus of claim 4 wherein said water supply means further includes a water distribution cap contiguous with said water injection wing and placed exterior of said housing, said water distribution cap having a passage communicating with a water supply hose and with said water passage in said water injection wing.

7. The apparatus of claim 4 wherein said water distribution means includes a water directing collar placed within said housing and directed so as to allow flow of said stream of abrasive particles and compressed air therethrough, said water injection wing being placed within said collar, said housing including a water directing passage communicating with a water supply hose and with a water directing groove on the outer circumference of said water directing collar, said water directing groove containing at least one water inlet port which communicates with said water passage in said water injection wing.

8. The apparatus of claim 7 wherein said water directing groove contains two radially opposed water inlet ports which communicate with said water passage in said water injection wing.

9. A process for blast cleaning a surface to remove contaminants therefrom comprising accelerating a stream of abrasive particles and compressed air through a blast nozzle, said blast nozzle comprising a longitudinal bore therethrough having an inlet, a converging section downstream of said inlet, an orifice downstream of said converging section and a diverging section downstream of said orifice leading to an outlet, injecting a pressurized water stream into said stream of abrasive particles and compressed air at a point downstream from said orifice and in said diverging section coaxially with the flow of said stream of abrasive particles and compressed air through said blast nozzle.

10. The process of claim 9 wherein said compressed air has a pressure about 30–125 psi and said water stream has pressure of at least about 1,000 psi.

11. The process of claim 10 wherein said water stream has a pressure of at least about 3,000 psi.

12. The process of claim 9 wherein said abrasive particles are water soluble.

13. The process of claim 12 wherein said water soluble abrasive particles comprise sodium bicarbonate.

14. The process of claim 9 wherein the velocity of said compressed air at the point wherein said water stream is injected into said stream of abrasive particles and compressed air is at least about sonic velocity and the velocity of the abrasive particles is substantially equivalent to the velocity of said water stream.

15. The process of claim 14 wherein said water stream is injected into said stream of abrasive particles and compressed air at a velocity of at least about 500 feet per second.

16. The process of claim 9, wherein the pressurized water stream is injected into said stream of abrasive particles and compressed air from a hollow tube extending from a water supply means coaxially through said bore and extending through said orifice, said hollow tube containing an outlet in said diverging section of said bore.

* * * * *